US011635190B2

(12) United States Patent
Yaphe et al.

(10) Patent No.: US 11,635,190 B2
(45) Date of Patent: Apr. 25, 2023

(54) ACOUSTIC LUMINAIRE STRUCTURE

(71) Applicant: AXIS LIGHTING INC., Lasalle (CA)

(72) Inventors: Howard Yaphe, Lasalle (CA); Andrew Miles, Lasalle (CA); Nicola Zarboni, Lasalle (CA); Jennifer Abboud, Lasalle (CA); Hanna Medwid, Lasalle (CA)

(73) Assignee: Axis Lighting Inc., Lasalle (CA)

( * ) Notice: Subject to any disclaimer, the term of this patent is extended or adjusted under 35 U.S.C. 154(b) by 0 days.

(21) Appl. No.: 17/321,304

(22) Filed: May 14, 2021

(65) Prior Publication Data

US 2021/0270450 A1 Sep. 2, 2021

Related U.S. Application Data

(63) Continuation-in-part of application No. 16/004,057, filed on Jun. 8, 2018, now Pat. No. 11,199,002, which
(Continued)

(51) Int. Cl.
*F21V 21/00* (2006.01)
*G10K 11/16* (2006.01)
(Continued)

(52) U.S. Cl.
CPC ..... *F21V 21/00* (2013.01); *E04B 1/86* (2013.01); *E04B 9/001* (2013.01); *E04B 9/006* (2013.01);
(Continued)

(58) Field of Classification Search
CPC ..... F21V 21/00; F21V 21/005; F21V 21/008; F21V 33/0056; G10K 11/16; F21S 8/06;
(Continued)

(56) References Cited

U.S. PATENT DOCUMENTS

D79,072 S 7/1929 Green
D158,483 S 5/1950 Mandell
(Continued)

FOREIGN PATENT DOCUMENTS

DE 202011104144 U1 * 1/2012 ..... F21S 2/00
EP 3128223 2/2017
(Continued)

OTHER PUBLICATIONS

Focal Point, "Seem 1 Acoustic Trio, LED Direct/Indirect," Brochure accessed on-line at: https://www.focalpointlights.com/products/acoustics-pendant-suspended-linear/seem-1-acoustic-trio-unlit-ausm1tp, (Feb. 2021).
(Continued)

*Primary Examiner* — Alan B Cariaso
(74) *Attorney, Agent, or Firm* — Barnes & Thornburg LLP

(57) ABSTRACT

A luminaire structure, comprises a plurality of housing segments, each with at least one lighting zone, and configured to be assembled to form a support structure defining at least one panel supporting zone for supporting at least one acoustic panel removably attached thereto, wherein each of the lighting zones in the support structure is oriented to be adjacent the at least one acoustic panel, and operable to receive a lighting module to deliver light to an interior space.

25 Claims, 18 Drawing Sheets

Related U.S. Application Data is a continuation-in-part of application No. 29/615,179, filed on Aug. 26, 2017, now Pat. No. Des. 926,346, and a continuation-in-part of application No. 29/610,783, filed on Jul. 14, 2017, now Pat. No. Des. 875,988.

(60) Provisional application No. 62/532,977, filed on Jul. 14, 2017.

(51) Int. Cl.

| | |
|---|---|
| ***F21V 33/00*** | (2006.01) |
| ***E04B 1/86*** | (2006.01) |
| ***E04B 9/00*** | (2006.01) |
| ***E04B 9/36*** | (2006.01) |
| ***E04B 9/22*** | (2006.01) |
| ***E04B 9/04*** | (2006.01) |

(52) U.S. Cl.
CPC ..... *E04B 9/0407* (2013.01); *E04B 9/225* (2013.01); *E04B 9/366* (2013.01); *F21V 33/0056* (2013.01); *G10K 11/16* (2013.01)

(58) Field of Classification Search
CPC .... F21S 8/061; F21S 8/068; F21S 4/20; F21S 4/28; E04B 1/86; E04B 9/001; E04B 9/006; E04B 9/0407; E04B 9/225; E04B 9/366
See application file for complete search history.

(56) References Cited

U.S. PATENT DOCUMENTS

| | | | |
|---|---|---|---|
| 2,555,000 | A | 5/1951 | Carl |
| 2,715,449 | A | 8/1955 | Simth |
| 2,759,093 | A | 8/1956 | Sundberg |
| D206,286 | S | 11/1966 | Ostyn |
| D274,363 | S | 6/1984 | Brownlee |
| D301,757 | S | 6/1989 | Hanson |
| D311,967 | S | 11/1990 | Herst |
| D330,090 | S | 10/1992 | Walter |
| 5,249,744 | A | 10/1993 | Ruthenberg |
| D348,533 | S | 7/1994 | Herst |
| D348,534 | S | 7/1994 | Herst |
| 6,450,418 | B1 | 9/2002 | Simpson |
| D464,457 | S | 10/2002 | Echito |
| 6,484,952 | B2 | 11/2002 | Koren |
| D493,009 | S | 7/2004 | Ken |
| D521,676 | S | 5/2006 | Richner |
| D569,027 | S | 5/2008 | Hakamada |
| D624,231 | S | 9/2010 | Karim |
| D651,336 | S | 12/2011 | Hartman |
| D662,245 | S | 6/2012 | Steffy |
| D670,422 | S | 11/2012 | Siekmann |
| D695,443 | S | 12/2013 | Kaule |
| D701,343 | S | 3/2014 | Ng |
| D708,382 | S | 7/2014 | McGowan |
| D716,485 | S | 10/2014 | McGowan |
| D723,204 | S | 2/2015 | McGowan |
| D729,968 | S | 5/2015 | Szalontai |
| D731,103 | S | 6/2015 | Wilke |
| D743,090 | S | 11/2015 | Wilcox |
| D744,690 | S | 12/2015 | Boyer |
| D776,855 | S | 1/2017 | Rashid |
| D788,356 | S | 5/2017 | Clements |
| D797,357 | S | 9/2017 | Vasylyev |
| D804,711 | S | 12/2017 | Leadford |
| D806,927 | S | 1/2018 | Rashid |
| D808,059 | S | 1/2018 | Li |
| D808,567 | S | 1/2018 | Goetzchaefer |
| D808,697 | S | 1/2018 | Heckler |
| D813,432 | S | 3/2018 | Koshiba |
| D824,075 | S | 7/2018 | Yu |
| D825,819 | S | 8/2018 | Sonneman |
| D826,462 | S | 8/2018 | Sonneman |
| 10,151,454 | B2 | 12/2018 | Farrell |
| 10,221,583 | B1 | 3/2019 | Elder |
| D849,992 | S | 5/2019 | Deng |
| D855,248 | S | 7/2019 | Tweel |
| D859,719 | S | 9/2019 | Yaphe |
| 10,443,823 | B2 | 10/2019 | Beland et al. |
| D895,195 | S | 9/2020 | Bou |
| 10,889,987 | B2 | 1/2021 | Patterson |
| 10,961,700 | B2 | 3/2021 | Udagawa |
| D926,346 | S | 7/2021 | Bou |
| D929,018 | S | 8/2021 | Hsu |
| D931,518 | S | 9/2021 | Mier-Langner |
| 2004/0174470 | A1 | 9/2004 | Mori |
| 2005/0094397 | A1 | 5/2005 | Yamada |
| 2006/0146531 | A1 | 7/2006 | Reo |
| 2008/0266842 | A1 | 10/2008 | Skidmore |
| 2009/0316396 | A1 | 12/2009 | Tsai |
| 2010/0195309 | A1 | 8/2010 | Cieslak |
| 2013/0235576 | A1 | 9/2013 | McGowan |
| 2013/0294061 | A1* | 11/2013 | Sorensen ..... F21S 8/046 362/217.17 |
| 2014/0117107 | A1 | 5/2014 | Vogtner |
| 2014/0226316 | A1 | 8/2014 | Medendorp, Jr. et al. |
| 2015/0068135 | A1 | 3/2015 | Waters |
| 2015/0338068 | A1 | 11/2015 | Bolscher |
| 2016/0178146 | A1* | 6/2016 | Oleske ..... F21V 21/047 52/28 |
| 2017/0072423 | A1 | 3/2017 | Vogtner |
| 2017/0082253 | A1 | 3/2017 | Sorensen et al. |
| 2017/0097152 | A1 | 4/2017 | Scribante |
| 2017/0111993 | A1 | 4/2017 | Lang |
| 2017/0268760 | A1 | 9/2017 | Xu |
| 2017/0276330 | A1 | 9/2017 | Ramirez |
| 2017/0356606 | A1 | 12/2017 | Rashidi |
| 2018/0147595 | A1 | 5/2018 | Vogtner |
| 2018/0231707 | A1 | 8/2018 | De |
| 2018/0283004 | A1 | 10/2018 | Gillette |
| 2018/0313503 | A1 | 11/2018 | Sonneman |
| 2019/0094456 | A1 | 3/2019 | Lee |
| 2019/0346119 | A1 | 11/2019 | Jam |
| 2020/0217488 | A1 | 7/2020 | Beland et al. |
| 2021/0088202 | A1 | 3/2021 | HuangZhenkun |
| 2021/0247056 | A1 | 8/2021 | Collado |

FOREIGN PATENT DOCUMENTS

| | | | |
|---|---|---|---|
| EP | 3543605 | 9/2019 | |
| KR | 100998336 B1 * | 12/2010 | ..... G10K 11/16 |

OTHER PUBLICATIONS

Focal Point, "Seem 1 LED Direct," Brochure accessed on-line at: https://www.focalpointlights.com/products/suspended-linear/seem-1-fsm1s, (May 2021).

U.S. Appl. No. 16/004,057, filed Jun. 8, 2018.

U.S. Appl. No. 29/615,179, filed Aug. 26, 2017.

U.S. Appl. No. 29/610,783, filed Jul. 14, 2017.

Axis Lighting, Jun. 1, 2020, Facebook, site visited Feb. 17, 2022, https://www.facebook.com/EclairageAxisLighting/photos/2605856129630304/ (Year: 2020).

DenicMic Solar Deck Lights Outdoor Fence Solar Lighting, Jun. 2, 2020, Amazon.com, site visited Feb. 18, 2022, url: https://www.amazon.com/dp/B08CSGLL Y6 (Year: 2020).

Eaton Corporation, Converge LED Architectural Luminaires, Neo-Ray (Jan. 2017).

Eaton, Corelite Divide-DWI (Jun. 14, 2017).

Eaton, SkyBar High Bay LED Luminaire (Jul. 28, 2015).

Esse-Ci Sri, ISDI_DIAMANTE (To the best of the Applicant's knowledge and understanding, the reference does not have a specific publication date but is believed to have been known by the Applicant on or after Dec. 1, 2017. Applicant believes it may have been available before the priority date of the application because the earliest date relating to this material that could be located online is Apr. 2017).

(56) References Cited

OTHER PUBLICATIONS

FLOS Architectural, "Infra-Structure Evo," accessed on the Internet at: https://arch.flosusa.com/systems/infra-structure-evo/, (believed to be publicly available prior to Mar. 4, 2020).
GE, LED Luminaires, www.gelighting.com/indoorsolutions (Apr. 2015).
GE, Lumination LED Luminaires, Linear Suspended Fixture, www.currentbyge.com (Sep. 22, 2016).
George Kovacs P5724-084-L Skinny, Apr. 5, 2016, Amazon.com, site visited Feb. 18, 2022, url: https://www.amazon.com/dp/B01DV7F4WW (Year: 2016).
GES Lighting Track System, GES 1-Circuit Global Track System (To the best of the Applicant's knowledge and understanding, the reference does not have a specific publication date but is believed to have been known by the Applicant on or after Dec. 1, 2017. Applicant believes it may have been available before the priority date of the application because the earliest date relating to this material that could be located online is Jun. 2017).
Infurma, GERA Lighting System 4 receives Interior Innovation Award 2013, Dec. 20, 2012, News Infurma, site visited Feb. 17, 2022, url: https://news.infurma.es/lighting-2/gera-lighting-system-4-receives-interior-innovation-award-2013/5303 (Year: 2012).
Lighting Services Inc., Recessed Track Installation (2015).
Lumenalpha™ spot, 209272, lumenpulse Global Tek 100 track system installation instructions (2016).
Lytespan Track lighting 9100 (1999).
Philips, Lytespan, Basic, 1 Circuit Track 6000 (2015).
Search Report & Written Opinion issued in Int'l Appl. PCT/CA2021/051071 (2021).
Vode Lighting, ZipThree Wall Mount (2017).
WAC Lighting, J Series 2 Circuit Track (2012).
XAL USA, "Move It System," accessed on the Internet at: https://www.xalusa.com/move-it-system, (believed to be publicly available prior to Mar. 4, 2020).
Zumtobel, "ZX2 continuous-row lighting system," accessed on the Internet at: https://www.zumtobel.com/com-en/products/zx2.html, (believed to be publicly available prior to Mar. 4, 2020).

* cited by examiner

ACOUSTIC LUMINAIRE STRUCTURE

REFERENCE TO CO-PENDING APPLICATIONS

This application is a Continuation-in-Part of U.S. patent application Ser. No. 16/004,057, filed Jun. 8, 2018, which claims the benefit of priority under 35 U.S.C. § 119(e) to U.S. Provisional Patent Application No. 62/532,977, filed Jul. 14, 2017. U.S. application Ser. No. 16/004,057 is also a Continuation-in-Part of U.S. Design Application No. 29/610,783, filed Jul. 14, 2017 (now Pat. No. D875,988) and is a Continuation-in-Part of U.S. Design Application No. 29/615,179, filed Aug. 26, 2017. The disclosures set forth in the referenced applications are incorporated herein by reference in their entireties The disclosures set forth in the following applications are also incorporated herein by reference in their entireties:

a) U.S. patent application Ser. No. 16/935,036, filed Jul. 21, 2020, entitled CEILING PANEL ASSEMBLY;
b) U.S. patent application Ser. No. 16/795,153, filed Feb. 19, 2020, entitled COUPLERS FOR LIGHT FIXTURES;
c) U.S. patent application Ser. No. 29/664,458, filed Sep. 25, 2018, entitled LIGHT FIXTURE COMPONENT, issued as U.S. Pat. No. D895,888 on Sep. 8, 2020;
d) U.S. patent application Ser. No. 29/664,989, filed Sep. 28, 2018, entitled LIGHT FIXTURE, issued as U.S. Pat. No. D911,592 on Feb. 23, 2021; and
e) U.S. patent application Ser. No. 17/162,990, filed Jan. 29, 2021, entitled LUMINAIRE STRUCTURE.

FIELD OF THE DISCLOSURE

The present disclosure relates to luminaire structures utilizing panel assemblies and associated structures.

BACKGROUND

Lighting and acoustics are two principal features in the design of a room space. Typically, however, acoustics and lighting are considered separately, and satisfied by light fixtures and acoustic panels of different configurations of shape, texture, thickness, placement, orientation and the like.

It may thus be desirable to provide novel approaches for lighting and/or acoustics, or at least to provide the public with one or more useful alternatives.

SUMMARY

In an aspect, there is provided a luminaire structure, comprising a plurality of housing segments, each with at least one lighting zone, and configured to be assembled to form a support structure defining at least one panel supporting zone for supporting at least one acoustic panel removably attached thereto, wherein each of the lighting zones in the support structure is oriented to be adjacent the at least one acoustic panel, and operable to receive a lighting module to deliver light to an interior space.

Some example embodiments may further comprise the at least one panel.

In some example embodiments, the at least one panel supporting zone may be configured to define at least one panel supporting plane, and wherein one or more of the lighting zones may be oriented with a light output disposed at an angle between about 0 and about 180 degrees relative to the panel supporting plane.

In some example embodiments, the light output may be oriented at about 90 degrees to the at least one panel supporting plane.

In some example embodiments, the at least one panel supporting plane may include a pair of substantially parallel panel supporting planes defined on corresponding opposed surfaces of the support structure to receive a corresponding one of a pair of acoustic panels.

In some example embodiments, the lighting zones may be configured to extend along and between an aligned pair of corresponding peripheral regions of the pair of acoustic panels.

In some example embodiments, each of the lighting zones may extend along a first length dimension of a corresponding housing segment and may include at least one first passage to receive the lighting module therein, for a first lighting mode, or to receive a cover module for a second non-lighting mode.

Some example embodiments may further comprise a plurality of hub segments to join with the housing segments to form the support structure.

In some example embodiments, each housing segment may include a mounting zone opposite the lighting zone, the mounting zone being oriented toward a region to be behind, or adjacent to, the at least one acoustic panel.

Some example embodiments may further comprise a mounting module to be received in the mounting zone, wherein the mounting module and/or the at least one acoustic panel may cooperate to form a mounting interface therebetween, for the removable attachment of the at least one acoustic panel to the support structure.

In some example embodiments, the mounting interface may include at least one first mounting structure on the mounting module to receive at least one second mounting structure on the at least one acoustic panel.

In some example embodiments, the first mounting structure may include at least one strut extending outwardly from the mounting module and at least one lateral web structure extending therefrom to engage a complementary tab structure on the acoustic panel.

In some example embodiments, the support structure may define a pair of opposed panels locating regions for locating respective acoustic panels on opposite sides of the support structure.

In another aspect, there is provided a luminaire assembly comprising a plurality of luminaire structures as defined in any clause, exemplary embodiment, or elsewhere in the present disclosure and claims.

In some example embodiments, the luminaire structures may be configured in one or more of a zig zag, T, C, X, triangular, rectangle or square orientations, in end-to-end or other configurations.

In another aspect, there is provided a method of assembling a luminaire structure, comprising:

providing a plurality of elongate housing segments, each with at least one peripheral region configured to define a lighting zone to receive a lighting module to deliver light to an interior space;

assembling the elongate housing segments together to form a support structure defining at least one panel supporting zone for supporting at least one acoustic panel; and installing the at least one acoustic panel on the at least one panel supporting zone.

Some example embodiments may further comprise the step of configuring the at least one panel supporting zone to define at least one panel supporting plane.

Some example embodiments may further comprise configuring the least one panel supporting plane as a pair of substantially parallel panel supporting planes defined on corresponding opposed surfaces of the support structure to receive a corresponding one of a pair of acoustic panels.

Some example embodiments may further comprise configuring the lighting zones to extend along and between an aligned pair of corresponding peripheral regions of the pair of acoustic panels.

Some example embodiments may further comprise one or more of configuring each of the lighting zones to extend along a first length dimension of a corresponding housing segment, so that each lighting zone includes at least one first passage, and inserting a lighting module in the first passage for a first lighting mode, or a cover module for a second non-lighting mode.

Some example embodiments may further comprise installing each of a plurality of hub segments between corresponding end regions of adjacent ones of the housing segments to form the support structure.

Some example embodiments may further comprise configuring each housing segment to include a mounting zone to be opposite the lighting zone and to be oriented toward a region to be behind or adjacent to the at least one acoustic panel.

Some example embodiments may further comprise providing a mounting module to be received in the mounting zone, so that the mounting module and/or the at least one acoustic panel cooperate to form a mounting interface therebetween.

Some example embodiments may further comprise providing the mounting interface by at least one first mounting structure on the mounting module to receive a second mounting structure on the at least one acoustic panel.

Some example embodiments may further comprise providing the first mounting structure as at least one strut extending outwardly from the mounting module and at least one lateral web extending therefrom.

Some example embodiments may further comprise configuring the support structure to define a pair of opposed panel locating regions for locating respective acoustic panels on opposite sides of the support structure.

In another aspect, there is provided a luminaire structure, comprising a plurality of housing segments, at least one of the housing segments having at least one lighting zone, and configured to be assembled to form a support structure defining at least one panel module supporting zone for supporting at least one panel module removably attached thereto, wherein the at least one lighting zone in the support structure is oriented to be adjacent the at least one panel module, and operable to receive a lighting module to deliver light to an interior space.

In some example embodiments, the at least one panel module may be selected from an acoustic panel module and a non-acoustic panel module interchangeably thereon.

In some example embodiments, the at least one lighting zone may be operable to receive the lighting module or a non-lighting module.

In some example embodiments, each of the plurality of housing segments may include at least one lighting zone, and wherein each of the at least one lighting zone is operable to receive the lighting module or a non-lighting module interchangeably therein.

Some example embodiments may further comprise the at least one panel module.

In some example embodiments, the at least one panel module supporting zone may be configured to define at least one panel module supporting plane, and wherein one or more of the lighting zones may be oriented with a light output disposed at an angle between about 0 and about 180 degrees relative to the panel module supporting plane.

In some example embodiments, the light output may be oriented at about 90 degrees to the at least one panel module supporting plane.

In some example embodiments, the at least one panel module supporting plane may include a pair of substantially parallel panel module supporting planes defined on corresponding opposed surfaces of the support structure to receive a corresponding one of a pair of panel modules.

In some example embodiments, the lighting zones may be configured to extend along and between an aligned pair of corresponding peripheral regions of the pair of panel modules.

In some example embodiments, a plurality of the housing segments may collectively include a plurality of lighting zones, and wherein each of the lighting zones may extend along a first length dimension of a corresponding housing segment and includes at least one first passage to receive the lighting module therein, for a first lighting mode, or to receive a cover module for a second non-lighting mode.

Some example embodiments may further comprise a plurality of hub segments to join with the housing segments to form the support structure.

In some example embodiments, each housing segment may include a mounting zone opposite the lighting zone, the mounting zone being oriented toward a region to be behind, or adjacent to, the at least one panel module.

Some example embodiments may further comprise a mounting module to be received in the mounting zone, wherein the mounting module and/or the at least one panel module cooperate to form a mounting interface therebetween.

In some example embodiments, the mounting interface may include at least one first mounting structure on the mounting module to receive a second mounting structure on the at least one panel module.

In some example embodiments, the first mounting structure may include at least one strut extending outwardly from the mounting module and at least one lateral web extending therefrom.

In some example embodiments, the support structure may define a pair of opposed panel module locating regions for locating respective panel modules on opposite sides of the support structure.

In another aspect, there is provided a luminaire assembly, comprising a plurality of luminaire structures as defined in any clause, exemplary embodiment, or elsewhere in the present disclosure and claims.

In some example embodiments, the luminaire structures may be configured in one or more of a zig zag, T, C, X, triangular, rectangle or square orientations, in end-to-end or other configurations.

In another aspect, there is provided a kit to build a luminaire structure, comprising:

- a plurality of housing segments;
- at least one of the housing segments having at least one lighting zone;
- at least one panel module;
- the plurality of housing segments configured to be assembled, or assembled, to form a support structure defining at least one panel module supporting zone for supporting the at least one panel module to be removably attached thereto;

wherein the at least one lighting zone in the support structure is oriented to be adjacent the at least one panel module, and operable to receive a lighting module to deliver light to an interior space.

Some example embodiments may further comprise a plurality of hub segments to join with the housing segments to form the support structure.

BRIEF DESCRIPTION OF THE FIGURES

Several exemplary embodiments of the present disclosure will be provided, by way of examples only, with reference to the appended drawings, wherein.

DETAILED DESCRIPTION

Figure 1:
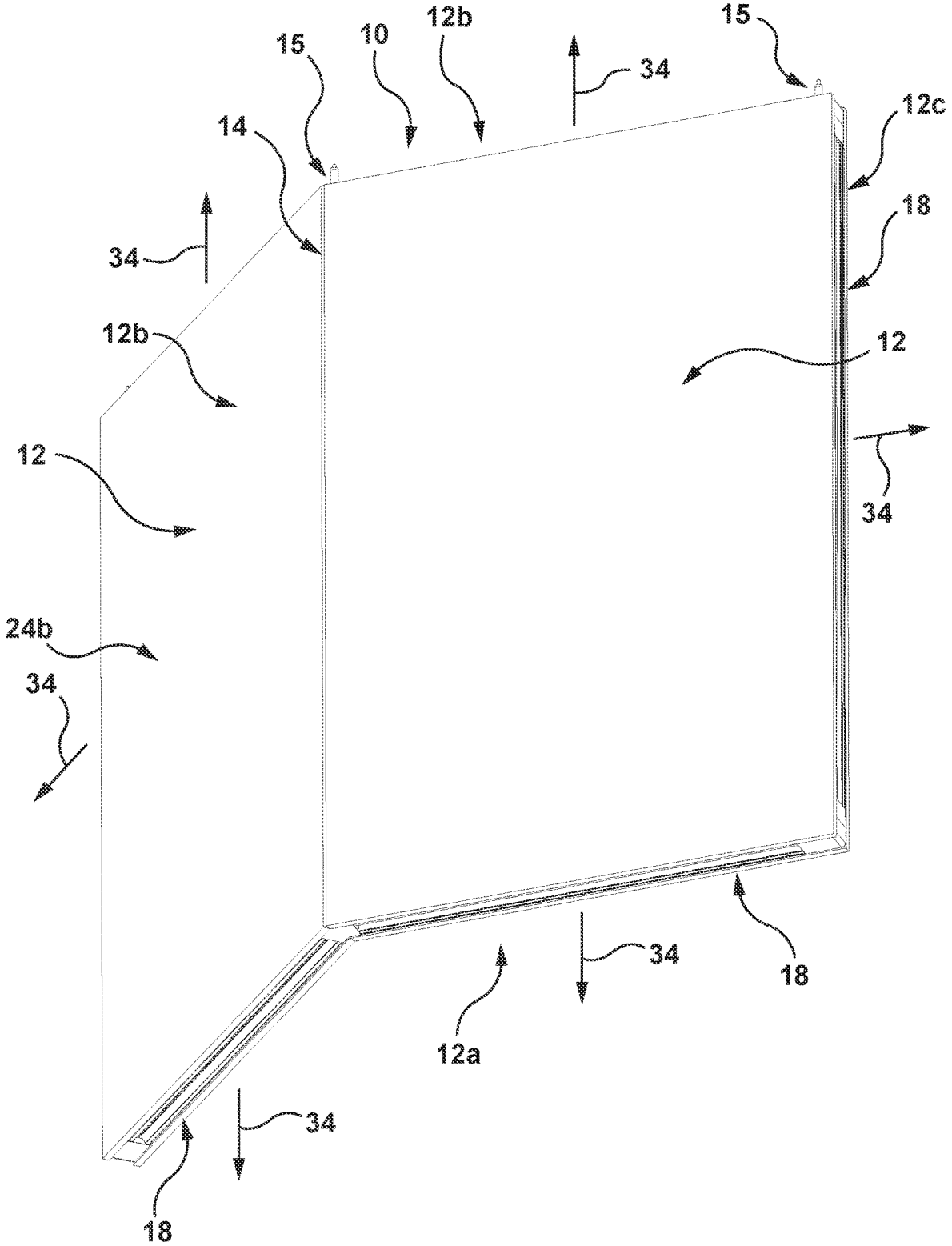
FIGS. 1 to 6 are views showing a luminaire structure.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical, mechanical or other connections or couplings. The terms upper, lower, and vertical are intended for operative context only and are not necessarily intended to limit the invention only to those configurations or orientations. In any instance in which the disclosure refers to a single instance of an element, example embodiments may include a multiple of such elements. The term "at least one" in reference to any element is not intended to force an interpretation on any other reference elsewhere in the disclosure to a single instance of an element to mean only one such instance of the element. Furthermore, and as described in subsequent paragraphs, the specific mechanical and/or other configurations illustrated in the drawings are intended to exemplify embodiments of the invention. However, other alternative mechanical and/or other configurations are possible which are considered to be within the teachings of the instant disclosure. Furthermore, any one element, feature, structure, function, of any aspect and/or example embodiment described in the present disclosure including the figures, clauses and/or claims herein, may itself be claimed on its own or be combined with any one or more elements, features, structures, functions, and/or steps from the same or any other aspects and/or example embodiments described in the present disclosure including the figures, clauses and/and claims herein.

The term "LED" used herein may include, but not be limited to, semiconductor, electroluminescent, organic, polymeric or other material based light sources commonly known as generally as light emitting diodes, as well as polymeric and other such light sources, equivalents and variants thereof.

Figure 2:
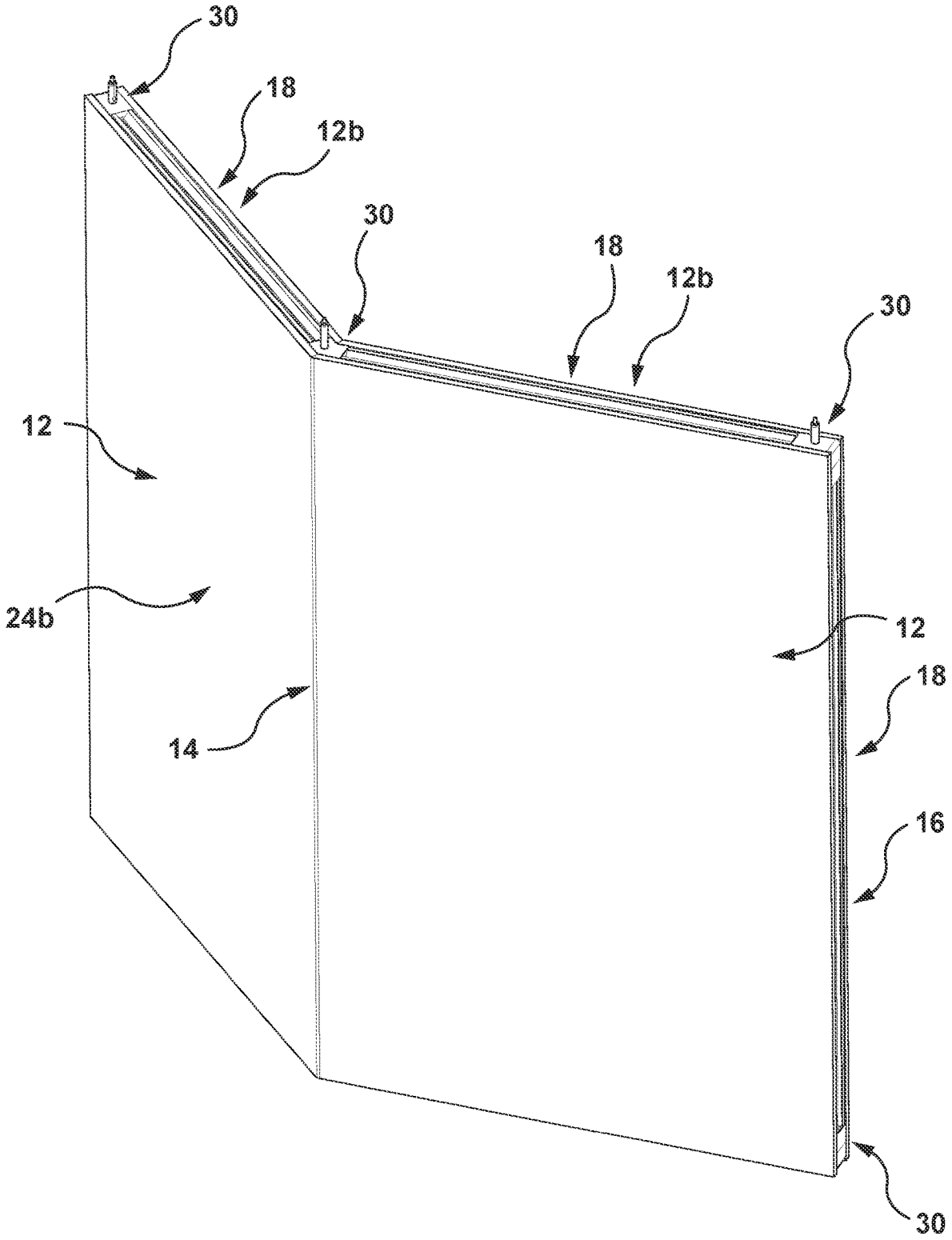
Figure 3:
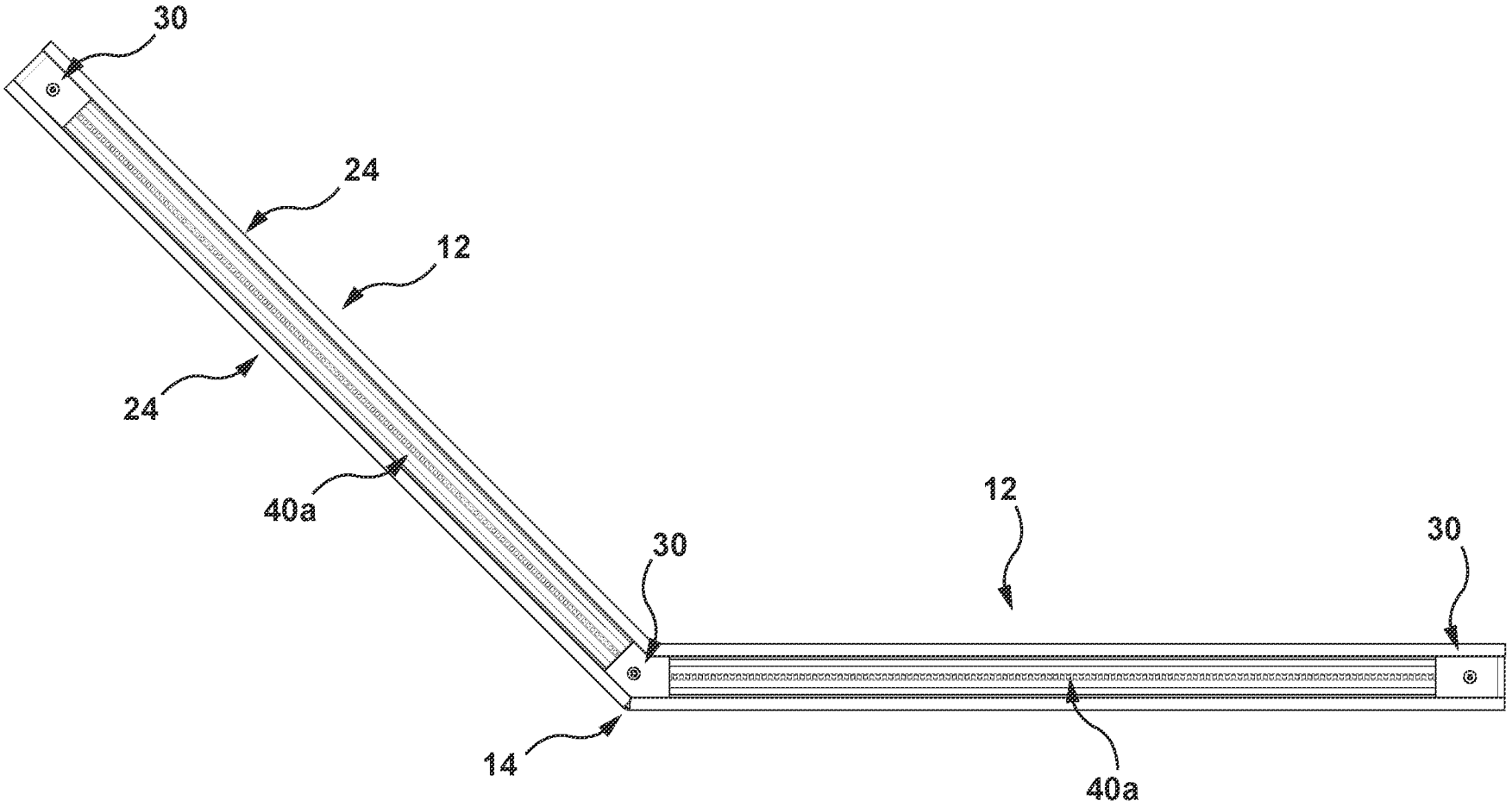
Figure 4:
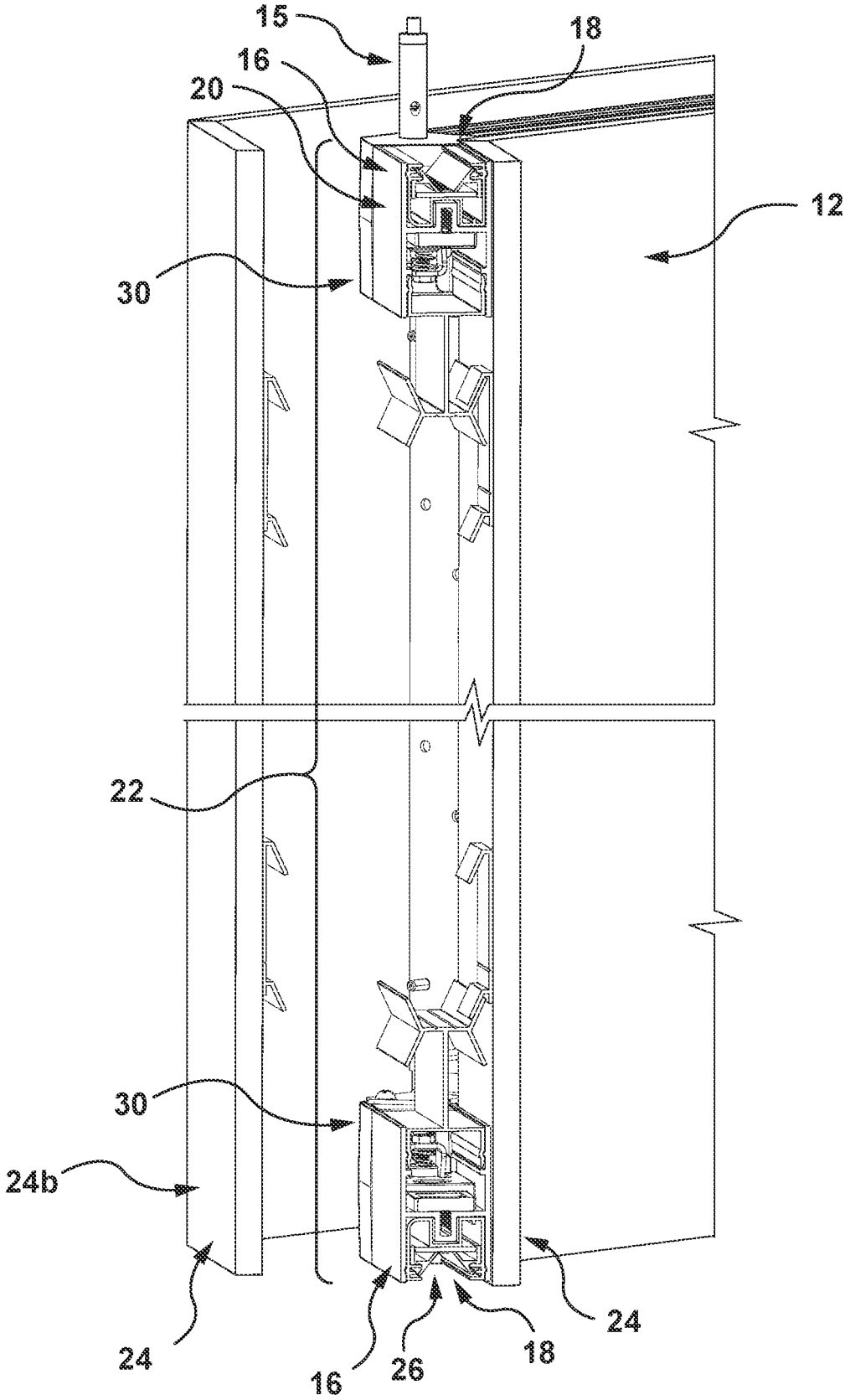
Figure 5:
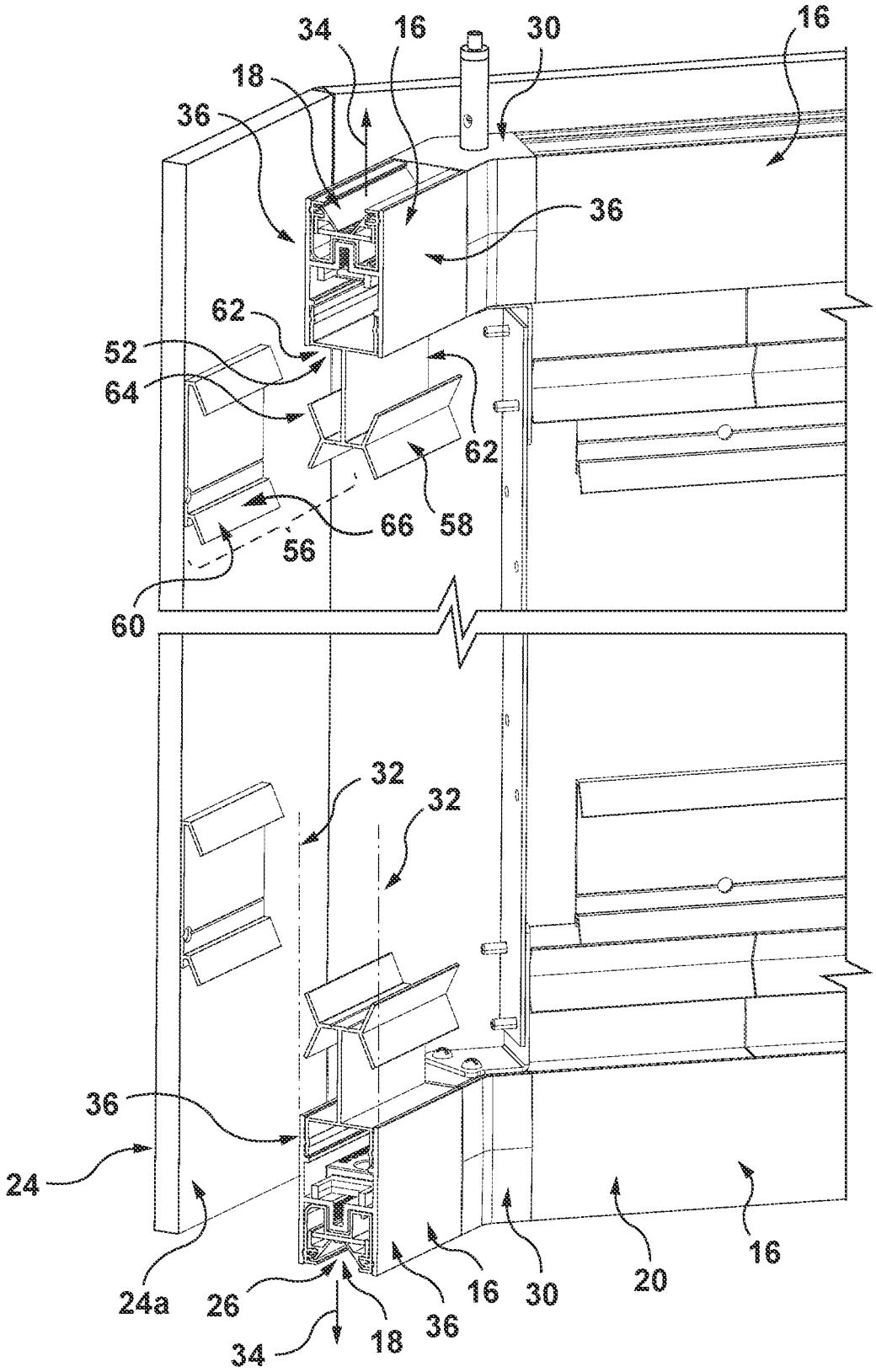
Figure 6:
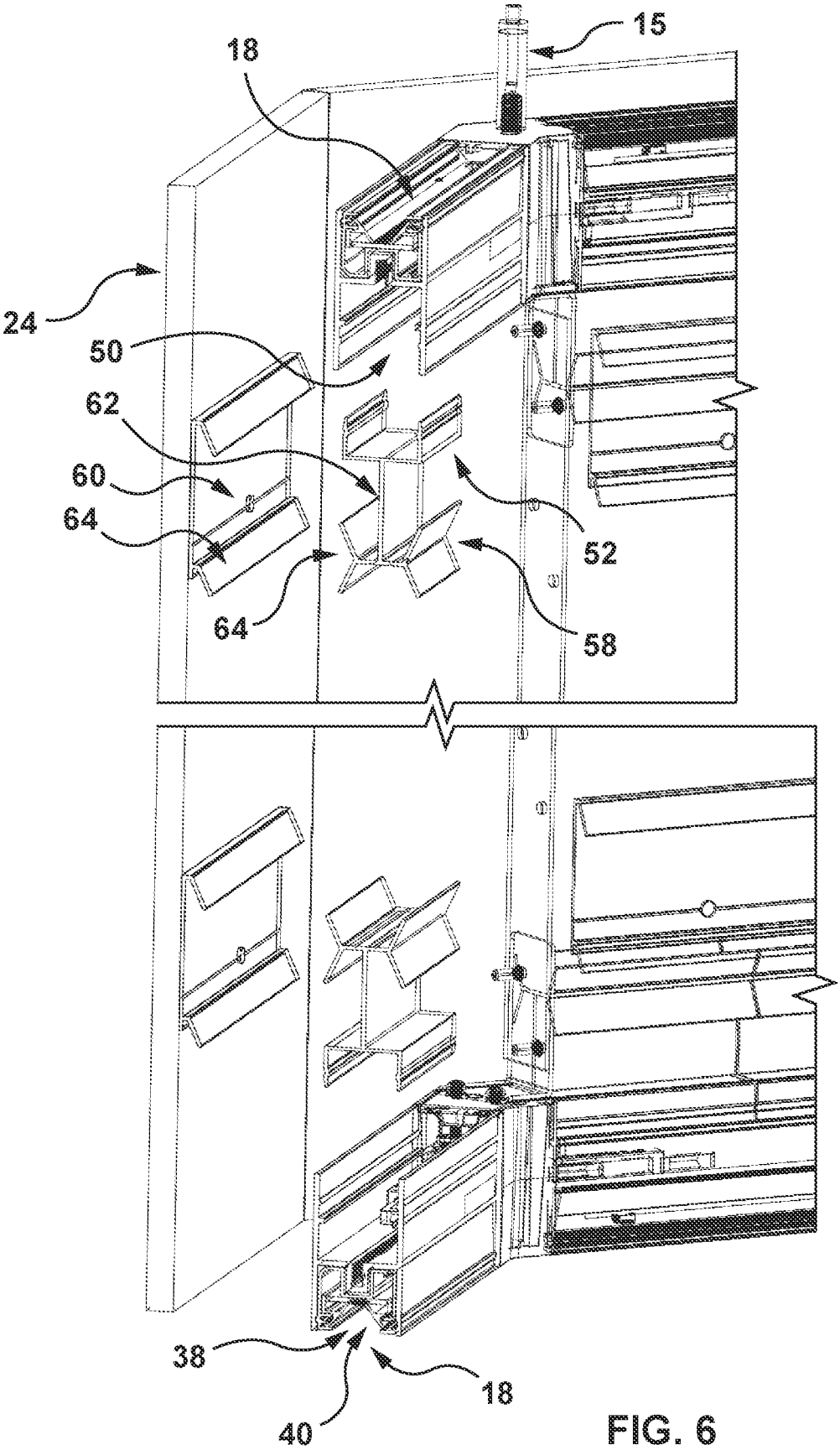

FIGS. 1 to 3 illustrate a luminaire assembly 10, comprising a number of luminaire structures, in this case two as shown at 12, which are shown joined along a common boundary 14 and configured to be supported relative to a ceiling surface, such as by way of a number of cable structures, portions of which are shown at 15. As can be seen in FIGS. 4 to 6, each luminaire structure 12 comprises a plurality of housing segments 16, with each providing at least one lighting zone 18, and configured to be assembled to form a support structure 20 (FIG. 4) defining at least one panel supporting zone 22 for supporting at least one, and in this case a pair of acoustic panels (or panel modules) 24. In this case, examples of the housing segments 16 may be disclosed in co-pending U.S. patent application Ser. No. 17/162,990 (the "'990 application"), filed Jan. 29, 2021, entitled LUMINAIRE STRUCTURE. The housing segments 16 include upper and lower housing segments 16 with opposed lighting zones 18. Referring to FIGS. 1 and 2, the lighting zones 18 for three housing segments 16 for the right-hand panel 12 can be seen along the respective bottom, top and side peripheral regions 12*a*, 12*b* and 12*c* respectively. Thus, at least one (in this case each) of the lighting zones 18 in the support structure 20 may be oriented to be adjacent the at least one acoustic panel 24, and operable to receive a lighting module 26 (FIG. 4) to deliver light to an interior space. In this instance, the luminaire assembly 10 has four discrete acoustic panels 24, in groups of two on opposite sides thereof.

Thus, as shown in FIG. 4, some example embodiments may provide the support structure 20 so that it may define a pair of opposed panel locating regions for locating respective acoustic panels on opposite sides of the support structure 20.

Referring to FIGS. 4 and 5, a plurality of hub segments 30 may be provided to join with the housing segments 16 to form the support structure 20. Examples of the hub segments 30 may be disclosed in co-pending U.S. patent application Ser. No. 16/795,153, filed Feb. 19, 2020, entitled COUPLERS FOR LIGHT FIXTURES (the "'153 application"). The hub segments 30 may also be configured to provide a positioning location for a corresponding one of the cable structures 15 as desired.

In some example embodiments, as shown in FIGS. 4 and 5, the at least one panel supporting zone 22 (FIG. 4) may be configured to define at least one panel supporting plane 32 (FIG. 5), while the lighting zones 18 may be oriented with a light output represented by arrows 34 disposed at an angle between about 0 and 180 degrees relative to the panel supporting plane 32. In the case of the example embodiment shown in FIGS. 1 to 6, the light output 34 is shown as oriented to be substantially parallel to the at least one panel supporting plane 32, and/or an inner or outer surface 24*a*, 24*b* respectively, of a corresponding one of the panels 24.

Referring to FIG. 5 the at least one panel supporting plane 20 may include a pair panel supporting planes 32 which substantially parallel and defined on corresponding opposed surfaces 36 of the support structure 32 to receive a corresponding one of a pair of acoustic panels 24.

Thus, in some example embodiments, the lighting zones 18 may be configured to extend along and between an aligned pair of corresponding peripheral regions of the pair of acoustic panels 24. Referring to FIG. 6 and in respect of the lower of the lighting zones 18, each of the lighting zones 18 may extend along a first length dimension of a corresponding housing segment and may include at least one first passage 38 to receive a lighting module 40 therein with an LED array 40*a* (for example such as those disclosed in the '990 application), for a first lighting mode.

Figure 7:
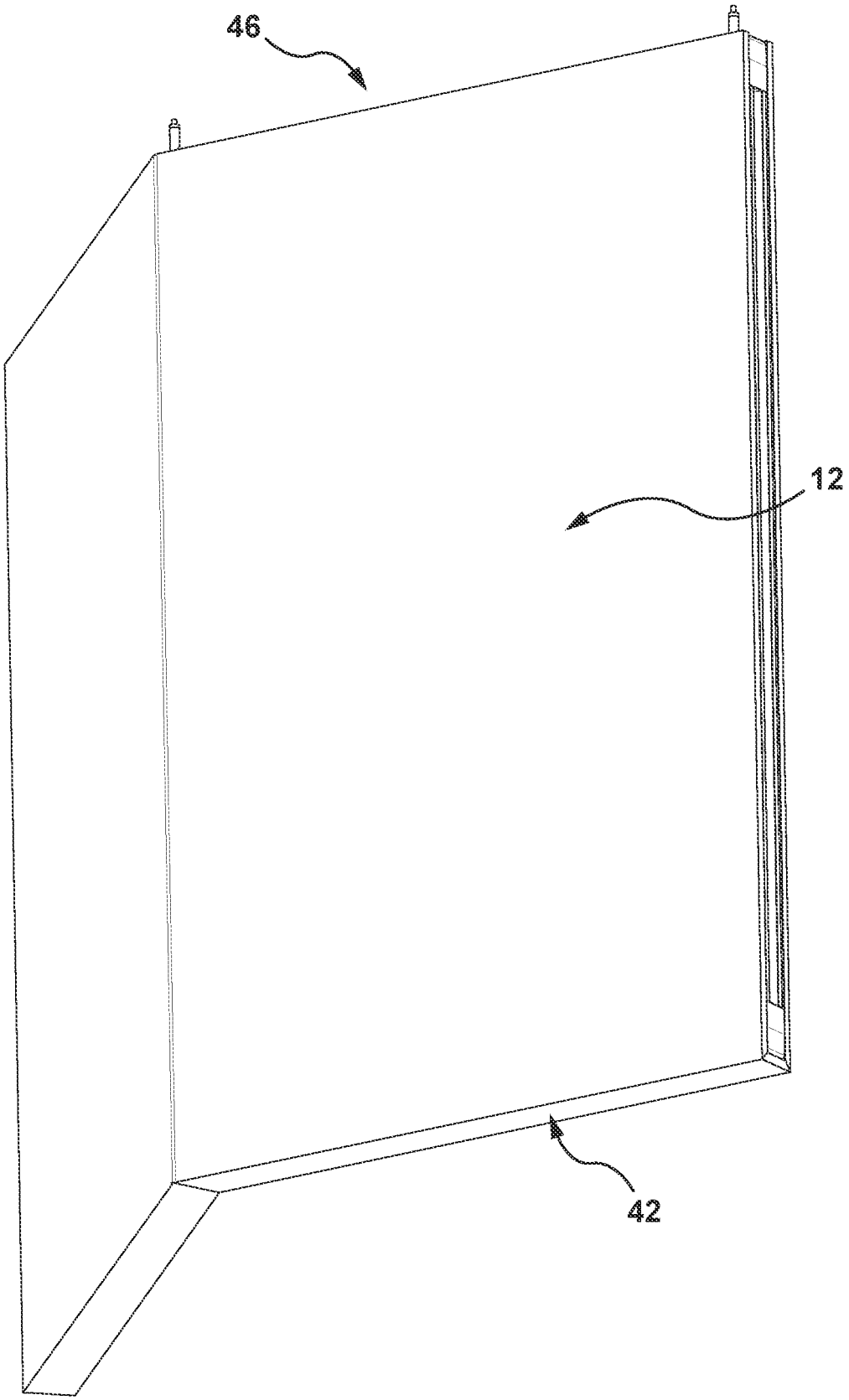
FIGS. 7 to 9 are views showing another luminaire structure.
Figure 8:
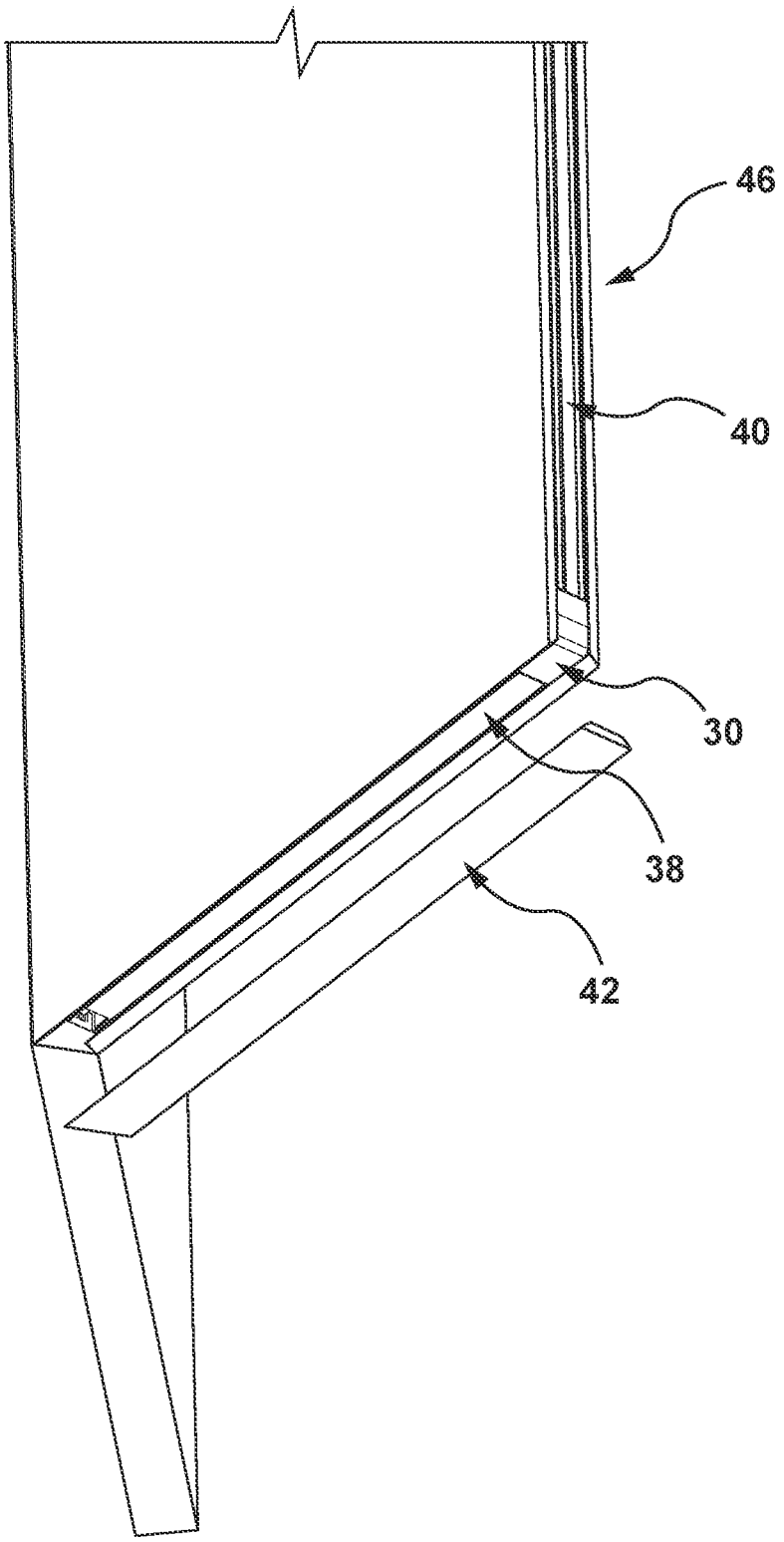
Figure 9:
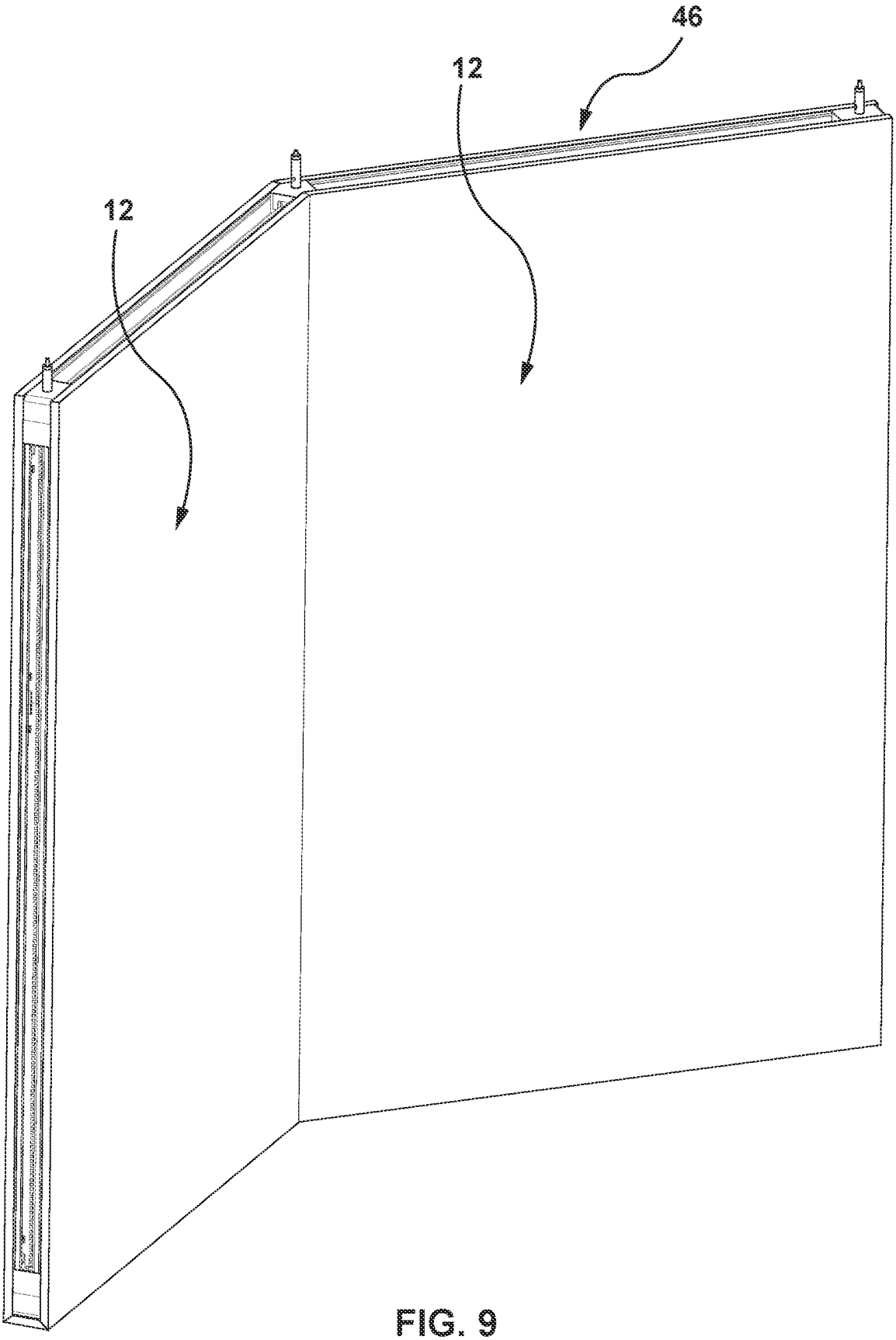

In another example embodiment, as shown in FIGS. 7 to 9, a luminaire assembly 46 is shown with a first passage 38 may be configured to receive a cover module 42 for a second non-lighting mode, for an instance where a lighting zone 18 is not required or desired along the corresponding peripheral region of the luminaire assembly. Thus, in some instances, each such peripheral region of the assembly 46 may be configured to receive a cover module 42, if desired, in order to provide a structure that does not include an LED array of the type shown at 40*a* for the luminaire assembly 10.

Referring to FIGS. 5 and 6, and as shown for the upper housing segment 16, each housing segment 16 may include a second passage providing a mounting zone 50 (FIG. 6) opposite the lighting zone 18, with the mounting zone 50 being oriented toward a region to be behind, or adjacent to, the acoustic panels 24. A mounting module 52 may also be provided to be received in the mounting zone 50, so that the mounting module 52 and/or each of the acoustic panels 24 may cooperate to form a mounting interface 56 therebetween (FIG. 5).

In some example embodiments, the mounting interface 56 may include at least one first mounting structure 58 to receive a second mounting structure 60 on the adjacent panel 24. Each first mounting structure 58 may include at least one strut 62 extending outwardly from the mounting module 52 and at least one lateral web 64 extending therefrom. In this case, the second mounting structure 60 may be provided with a tab shown at 66 to engage the corresponding lateral web 64.

Thus, in some example embodiments such as the luminaire assemblies 10 (of FIGS. 1 to 6) and 46 (of FIGS. 7 to 9) provide two luminaire structures 12 mounted at an angle relative to one another along the boundary 14. Other example embodiments may provide alternative relative orientations of two or more such luminaire structures 12. In the case of luminaire assembly 46, one or more such luminaire structures may be transformed into or replaced by non-luminaire structures if all peripheral regions 12*a* to 12*c* of one or more of the structures 12 are provided with the cover modules 42 rather than a lighting module 26. Thus, luminaire assemblies herein may provide a plurality of luminaire acoustic structures 12 which are interspersed, if desired, with non-luminaire acoustic structures in whole or in part, in some example embodiments with interchangeable modules and/or segments, as discussed above.

In some example embodiments, the luminaire assembly 10 may be provided so that a number of the luminaire structures 12 may be configured in one or more of a zig zag, T, C, X, triangular, rectangle or square orientations, in end-to-end or other configurations. One or more of the acoustic panels 24 as shown for luminaire assembly 10 may be replaced with non-acoustic panels, if desired. For instance, in the case of the luminaire assembly 10, one or more of the acoustic panels 24 may be replaced by a non-acoustic panel, such as one with a mirrored or other patterned, textured and/or shaped surface.

Figure 10:
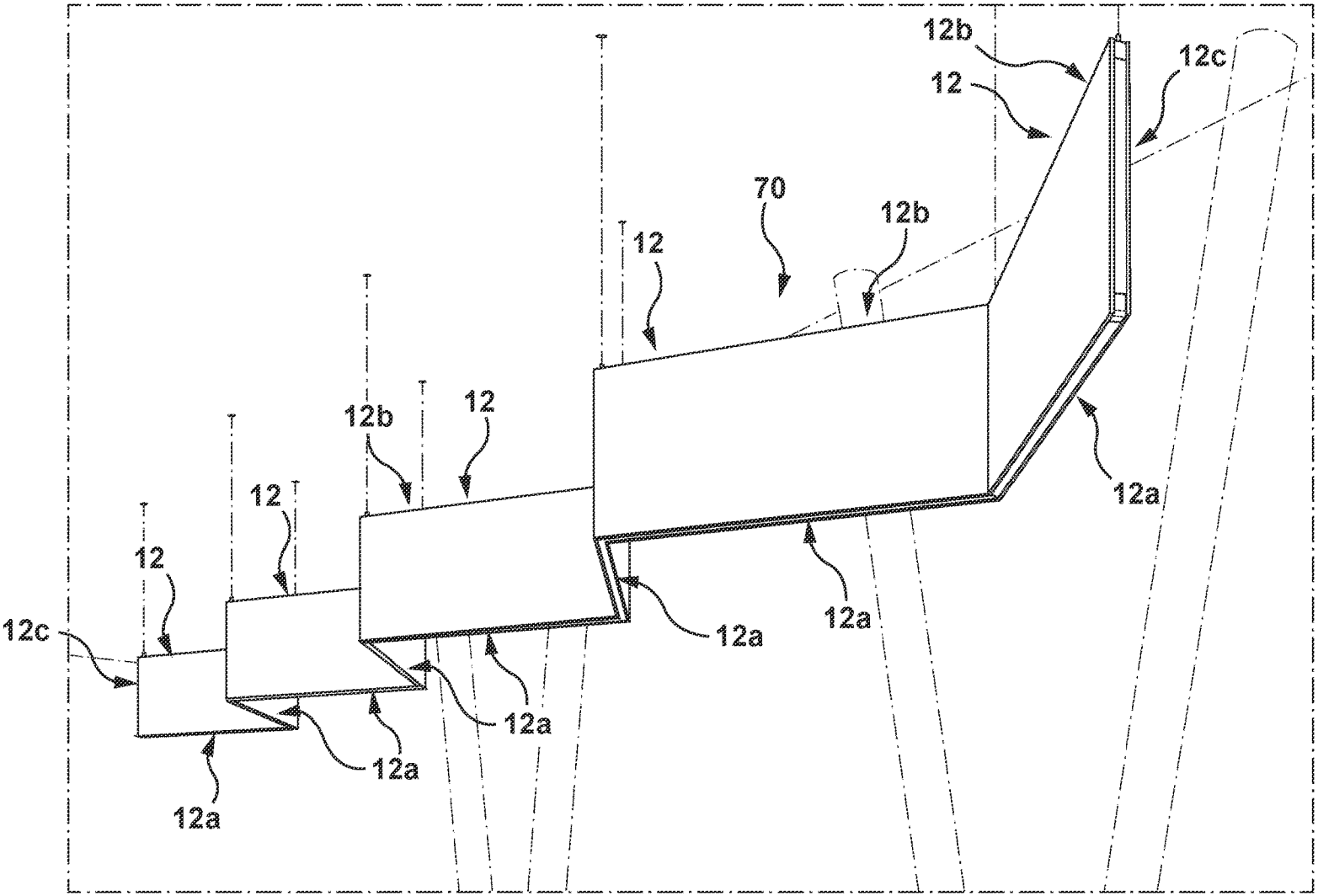
FIGS. 10 and 11 are views showing other luminaire structures.

An example embodiment may be seen in FIG. 10 showing a luminaire assembly 70 with eight luminaire structures 12 in zig-zag configuration, with lighting zones shown to extend along the near and far end peripheral regions 12*c*, and all of the lower peripheral regions 12*a* (and, if desired, along one or more of the upper regions 12*b*) extending along the length of the luminaire assembly 70.

Figure 11:
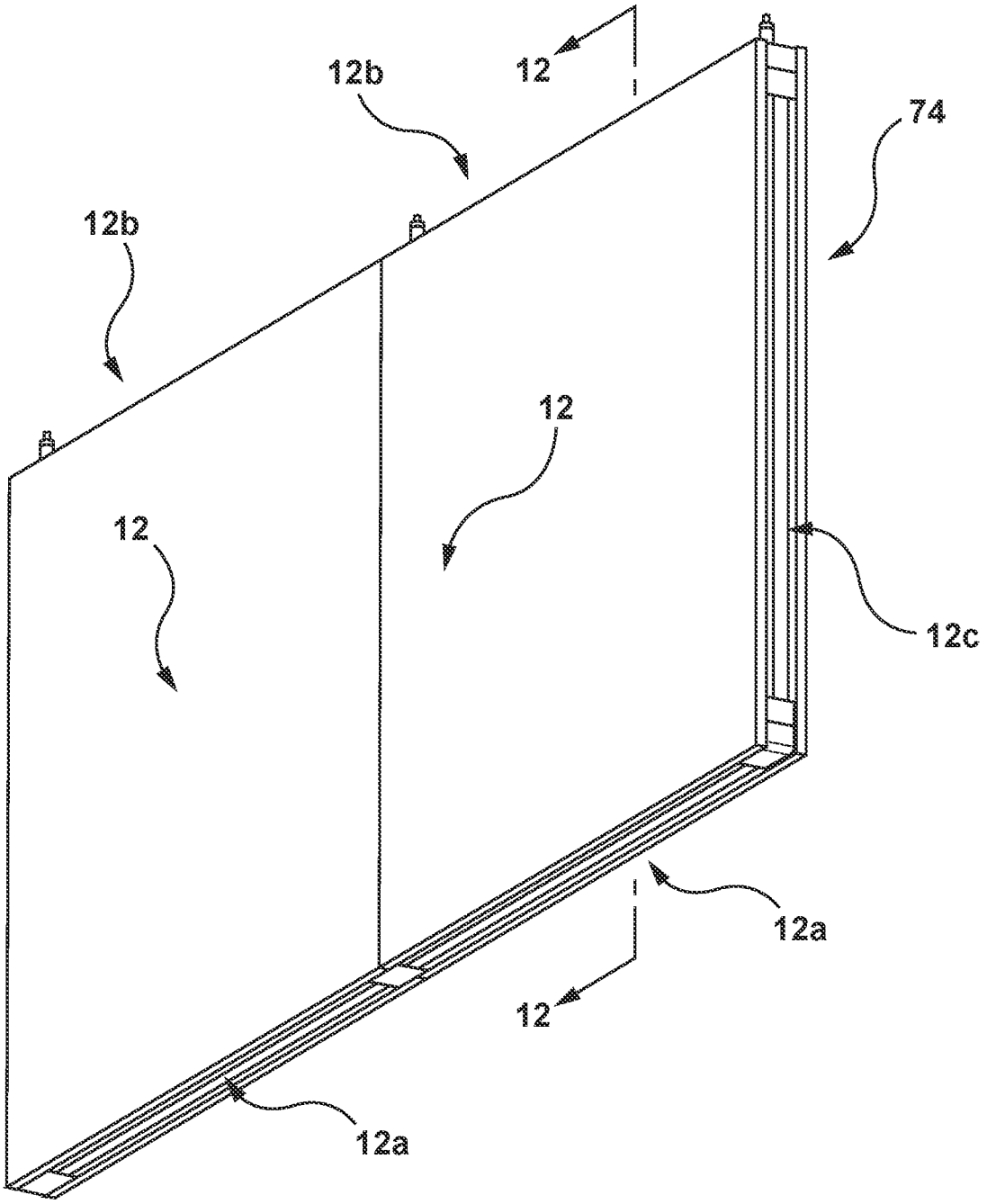

FIGS. 11 to 18 illustrate an example embodiment of a method to form a luminaire assembly shown at 74 in FIG. 11, in this case with two luminaire structures 12 in a planar configuration.

Figure 12:
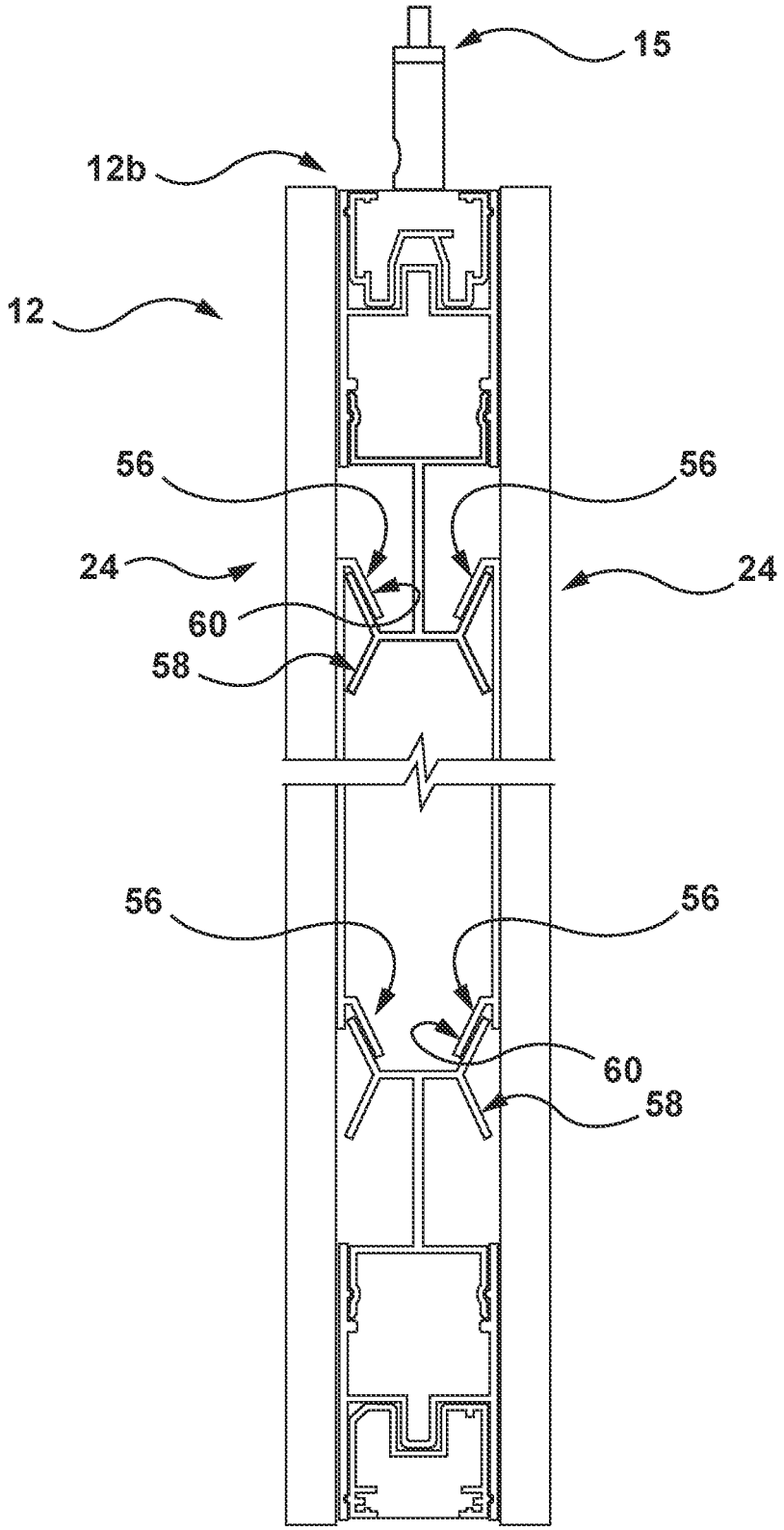
FIGS. 12 to 18 are views showing a method of assembling the luminaire structure of FIG. 11.
Figure 13:
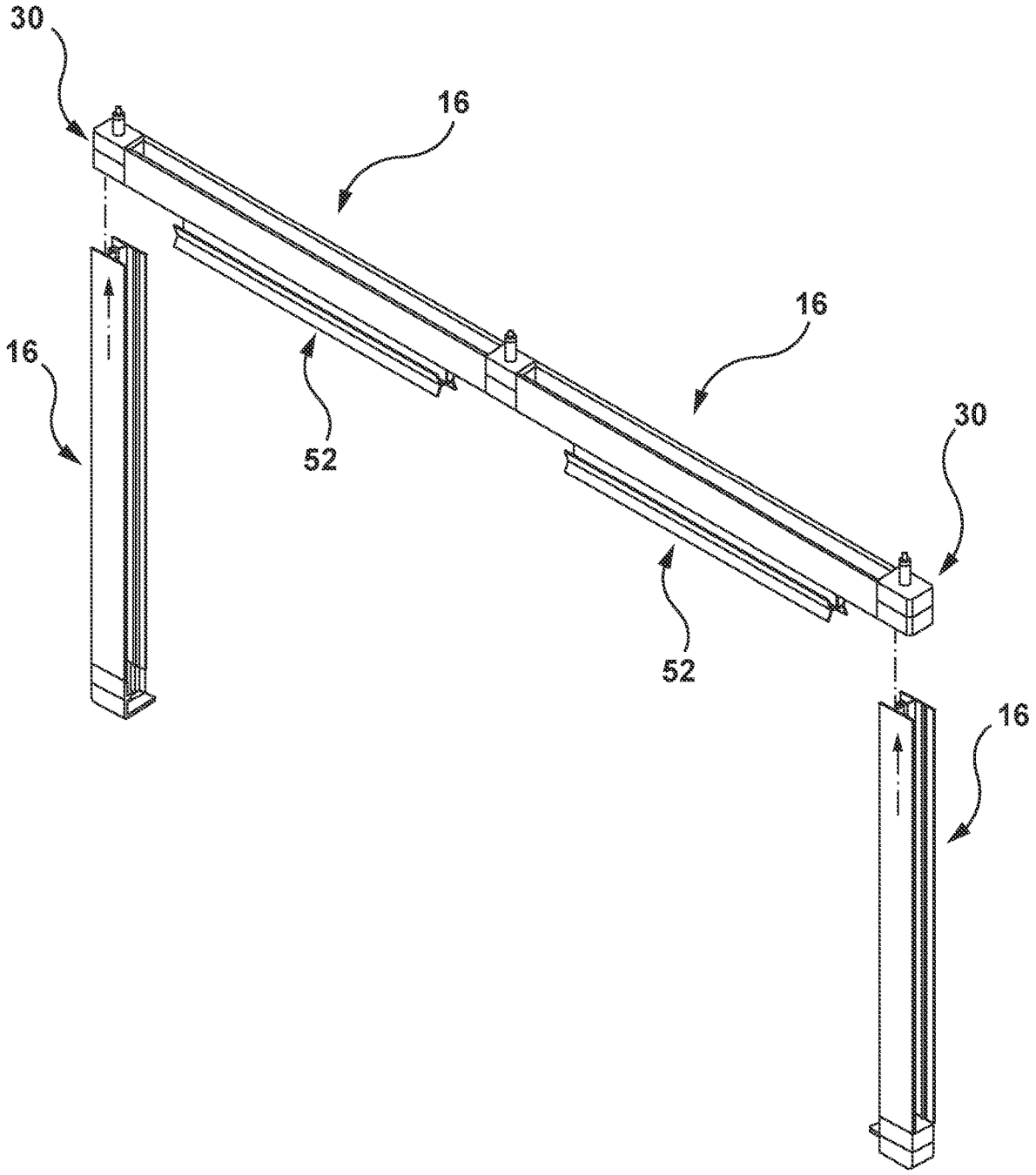
Figure 14:
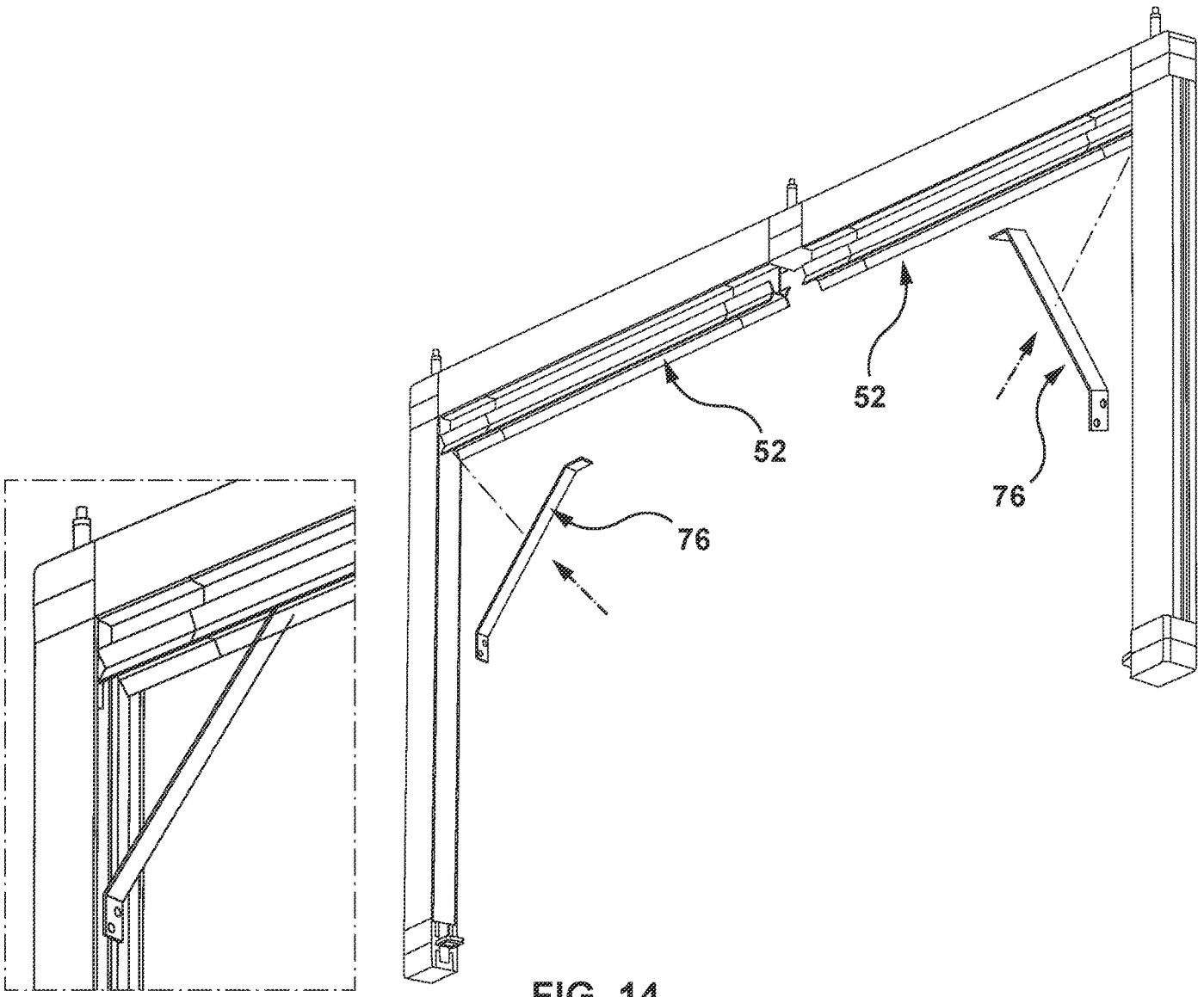
Figure 15:
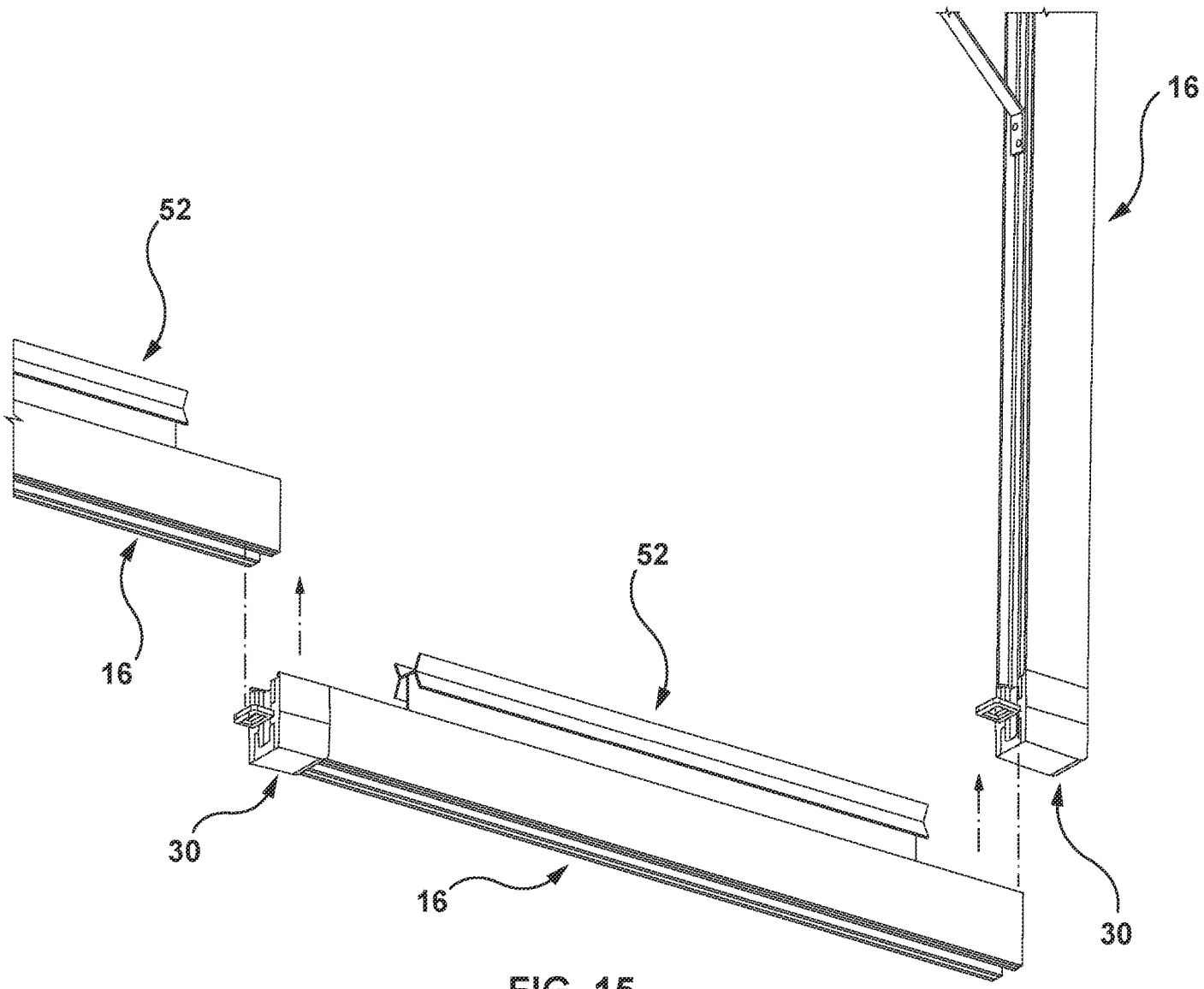
Figure 16:
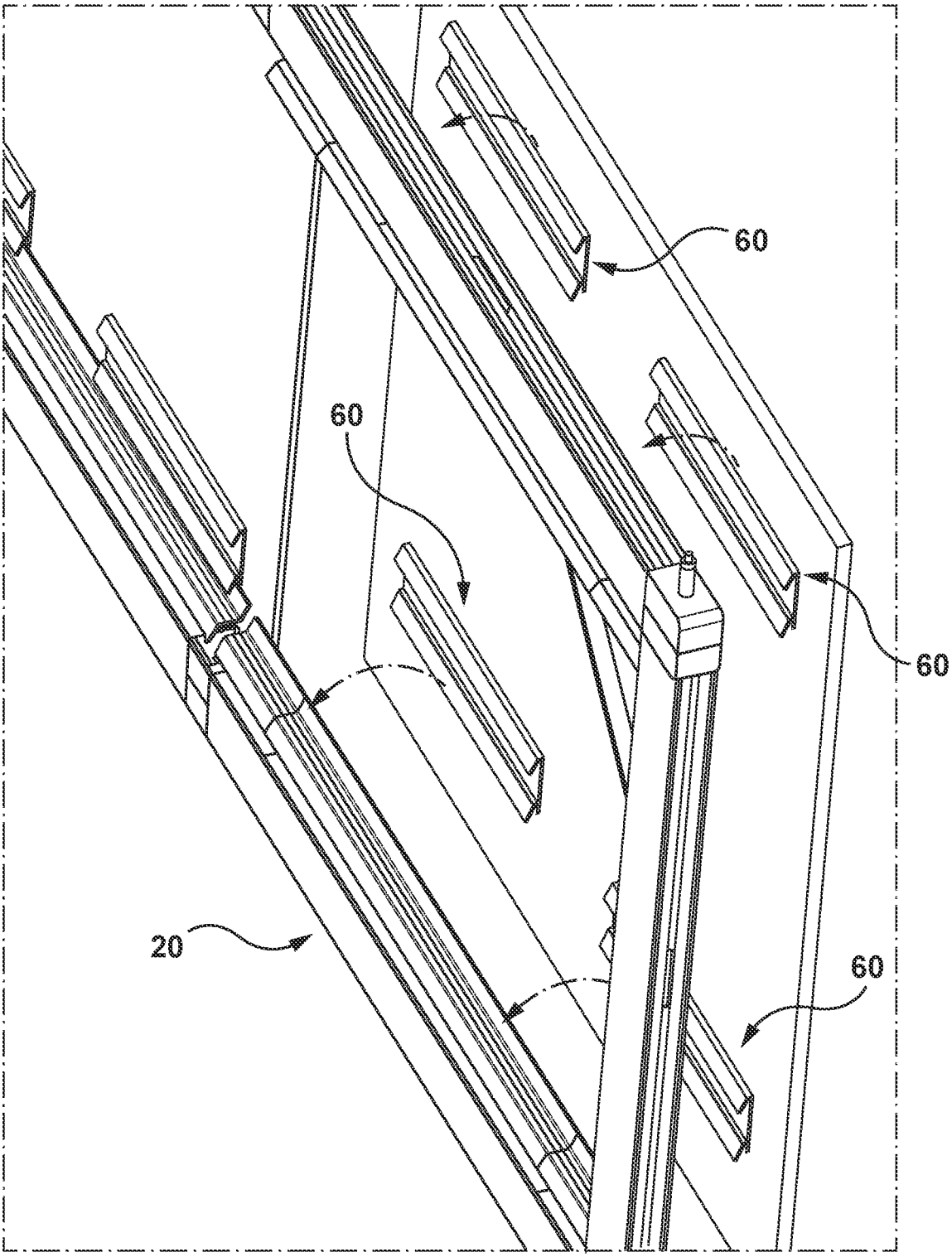

FIG. 12 illustrates a sectional view of the right-hand luminaire structure 12, with two acoustic panels 24 assembled by the corresponding mount interfaces 56. As will be discussed with reference to FIGS. 13 to 18, the method may involve providing a plurality of elongate housing segments 16 shown in FIGS. 13 to 15, each with at least one peripheral region configured to define a lighting zone to receive a lighting module to deliver light to an interior space. In this case, two elongate housing segments 16 may form two upper peripheral regions 12*b*, two elongate housing segments 16 may form two lower peripheral regions 12*a*, and each of two elongate housing segments 16 may form a corresponding two end peripheral regions 12*c*.

Each of the two elongate housing segments 16 forming the two upper peripheral regions 12*b*, and the two elongate housing segments 16 forming the two lower peripheral regions 12*a*, may also be equipped with a corresponding mounting module 52 for coupling with panels 24 as will be described. Lighting modules 40 may then be installed in those elongate housing segments 16 which correspond to the one or more peripheral regions designated to provide one or more light outputs 34. Each of a plurality of hub segments 30 may be located between and coupled with corresponding end regions of adjacent ones of the elongate housing segments 16, following the method discussed in the above mentioned '135 application, thus to form the support structure 20, a portion of which may be seen in FIG. 16. Corner braces 76 may be deployed as need be in the corners or elsewhere to improve strength and stiffness if the support structure 20. For those elongate housing segments 16 whose peripheral regions are not to provide light outputs 34, cover modules 42 may then be installed either before or after connections with the hug segments 30.

Figure 17:
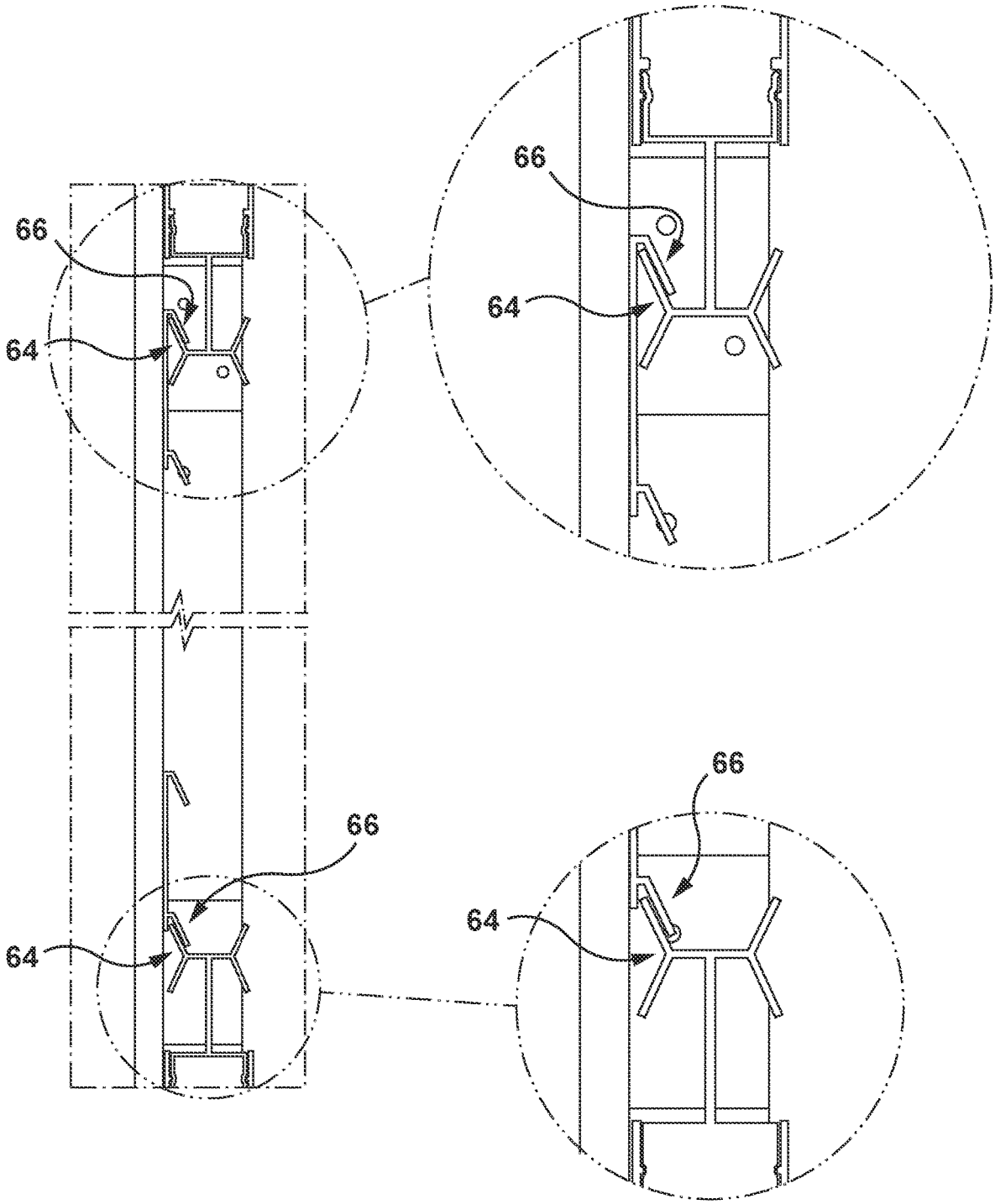
Figure 18:
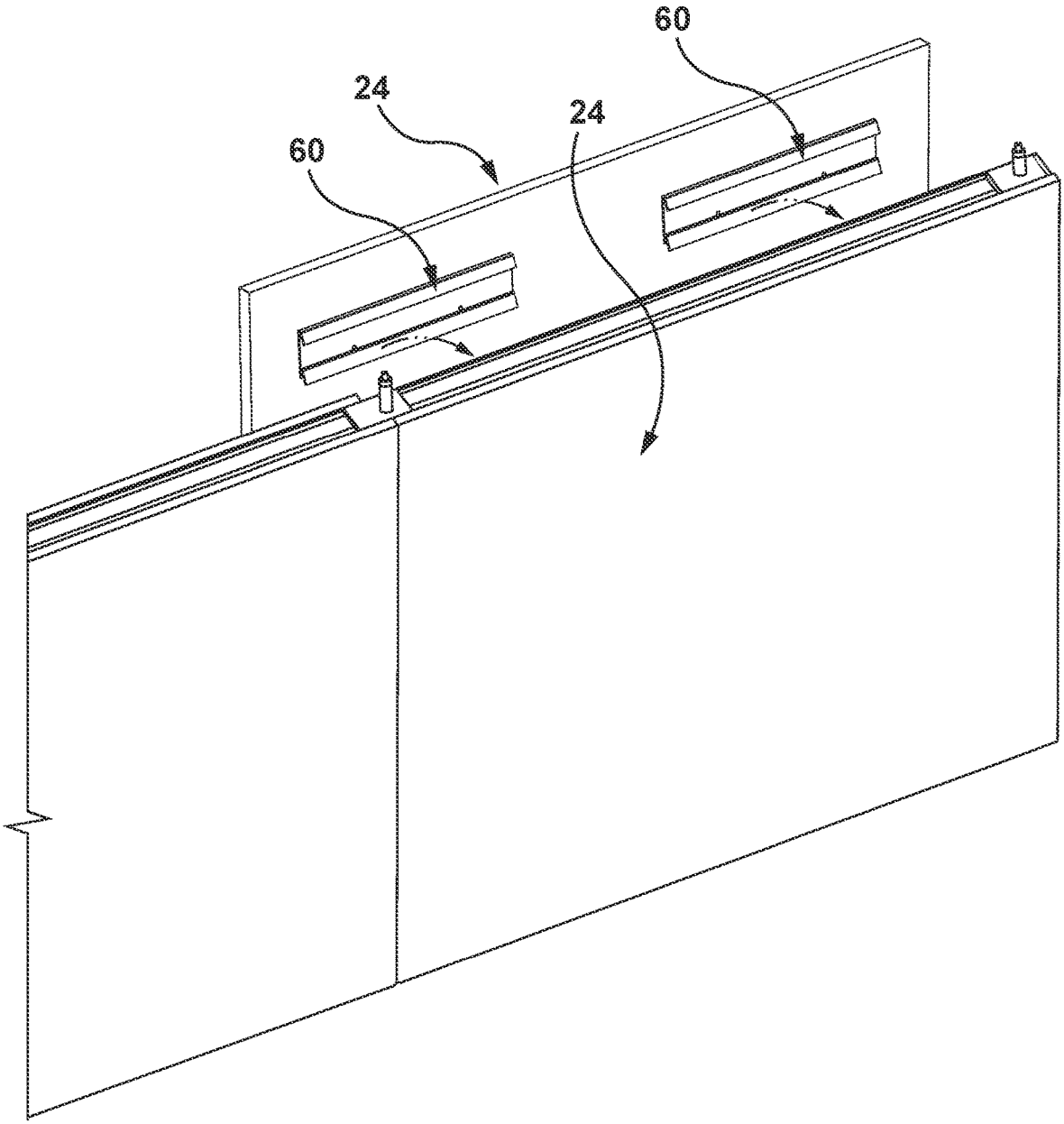

FIGS. 17 and 18 show the installation of the acoustic panels 24 provided with the mounting structures 60, with the corresponding upper and lower tabs 66 being aligned with a corresponding lateral web 64.

Broken lines may be provided for purposes of illustrating portions of the design and are directed to environment. The subject matter herein includes any of the present figures, or new figures based on the present figures, with one or more or less such broken lines shown in solid lines and vice versa. Thus, any change of such one or more broken lines to one or more solid lines, and vice versa, is not new matter.

Structures herein may be presented with symbolic break lines. The appearance of a portion of the luminaire structure between the break lines does not form part of the design. A separation and a bracket are used to indicate that, for ease of illustration, the specific dimension of the article associated with the separation and bracket is not claimed and is to be broadly interpreted. The subject matter herein includes any of the present figures with any such symbolic break lines removed, or with one or more further symbolic break lines added. Thus, any removal or addition of one or more any such symbolic break lines is not new matter.

The luminaire structure designs are not limited to the scale shown herein.

The figures herein present the ornamental designs for luminaire structures as shown and described.

While the present disclosure describes various exemplary embodiments, the disclosure is not so limited. To the contrary, the disclosure is intended to cover various modifications and equivalent arrangements, as will be readily appreciated by the person of ordinary skill in the art.

The invention claimed is:

1. A luminaire structure, comprising a plurality of housing segments, each with at least one lighting zone, and configured to be assembled to form a support structure defining at least one panel supporting zone for supporting at least one acoustic panel removably attached thereto, wherein each of the lighting zones in the support structure is oriented to be adjacent the at least one acoustic panel, and operable to receive a lighting module to deliver light to an interior space, wherein the at least one panel supporting zone includes a pair of opposed panel supporting planes defined on corresponding opposed surfaces of the support structure to receive a corresponding one of a pair of panels including the at least one acoustic panel.

2. The luminaire structure as defined in claim 1, further comprising the at least one panel.

3. The luminaire structure of claim 1, wherein the at least one panel supporting zone is configured to define at least one panel supporting plane, and wherein one or more of the lighting zones are oriented with a light output disposed at an angle between about 0 and about 180 degrees relative to the panel supporting plane.

4. The luminaire structure of claim 3, wherein the light output is oriented at about 90 degrees to the at least one panel supporting plane.

5. The luminaire structure of claim 1, wherein the lighting zones are configured to extend along and between an aligned pair of corresponding peripheral regions of the pair of panels.

6. The luminaire structure of claim 1, wherein each of the lighting zones extends along a first length dimension of a corresponding housing segment and includes at least one first passage to receive the lighting module therein, for a first lighting mode, or to receive a cover module for a second non-lighting mode.

7. The luminaire structure of claim 1, further comprising a plurality of hub segments to join with the housing segments to form the support structure.

8. The luminaire structure of claim 1, wherein each housing segment includes a mounting zone opposite the lighting zone, the mounting zone being oriented toward a region to be behind, or adjacent to, the at least one acoustic panel.

9. The luminaire structure of claim 8, further comprising a mounting module to be received in the mounting zone, wherein the mounting module and/or the at least one acoustic panel cooperate to form a mounting interface therebetween, for the removable attachment of the at least one acoustic panel to the support structure.

10. The luminaire structure of claim 9, wherein the mounting interface includes at least one first mounting structure on the mounting module to receive at least one second mounting structure on the at least one acoustic panel.

11. The luminaire structure of claim 10, wherein the first mounting structure includes at least one strut extending outwardly from the mounting module and at least one lateral web structure extending therefrom to engage a complementary tab structure on the acoustic panel.

12. The luminaire structure of claim 1, wherein the support structure defines a pair of opposed panel locating regions for locating respective panels including the at least one acoustic panel on opposite sides of the support structure.

13. A luminaire assembly comprising a plurality of luminaire structures of claim 1.

14. The luminaire assembly of claim 13, wherein the luminaire structures are configured in one or more of a zig zag, T, C, X, triangular, rectangle or square orientations, in end-to-end or other configurations.

15. The luminaire structure of claim 1, wherein the pair of opposed panel supporting are substantially parallel.

16. A method of assembling a luminaire structure, comprising:

providing a plurality of elongate housing segments, each with at least one peripheral region configured to define a lighting zone to receive a lighting module to deliver light to an interior space;

assembling the elongate housing segments together to form a support structure defining at least one panel supporting zone for supporting at least one acoustic panel; and installing the at least one acoustic panel on the at least one panel supporting zone;

configuring the at least one panel supporting zone to define a pair of panel supporting planes defined on corresponding opposed surfaces of the support structure to receive a corresponding one of a pair of panels, including the at least one acoustic panel.

17. The method of claim 16, further comprising configuring the lighting zones to extend along and between an aligned pair of corresponding peripheral regions of the pair of acoustic panels.

18. The method of claim 16 further comprising configuring each of the lighting zones to extend along a first length dimension of a corresponding housing segment, so that each lighting zone includes at least one first passage, and inserting a lighting module in the first passage for a first lighting mode, or a cover module for a second non-lighting mode.

19. The method of claim 16, further comprising installing each of a plurality of hub segments between corresponding end regions of adjacent ones of the housing segments to form the support structure.

20. The method of claim 16, further comprising configuring each housing segment to include a mounting zone to be opposite the lighting zone and to be oriented toward a region to be behind or adjacent to the at least one acoustic panel.

21. The method of claim 20, further comprising providing a mounting module to be received in the mounting zone, so that the mounting module and/or the at least one acoustic panel cooperate to form a mounting interface therebetween.

22. The method of claim 21, further comprising providing the mounting interface by at least one first mounting structure on the mounting module to receive a second mounting structure on the at least one acoustic panel.

23. The method of claim 22, further comprising providing the first mounting structure as at least one strut extending outwardly from the mounting module and at least one lateral web extending therefrom.

24. The method of claim 23, further comprising configuring the support structure to define a pair of opposed panel locating regions for locating respective acoustic panels on opposite sides of the support structure.

25. The luminaire structure of claim 16, wherein the pair of opposed panel supporting are substantially parallel.

* * * * *